US007156503B2

(12) United States Patent
Isono et al.

(10) Patent No.: US 7,156,503 B2
(45) Date of Patent: Jan. 2, 2007

(54) INK JET HEAD

(75) Inventors: Hitoshi Isono, Tenri (JP); Hirotsugu Matoba, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 202 days.

(21) Appl. No.: 10/505,737

(22) PCT Filed: Feb. 6, 2003

(86) PCT No.: PCT/JP03/01273

§ 371 (c)(1),
(2), (4) Date: Aug. 26, 2004

(87) PCT Pub. No.: WO03/072361

PCT Pub. Date: Sep. 4, 2003

(65) Prior Publication Data

US 2005/0157094 A1 Jul. 21, 2005

(30) Foreign Application Priority Data

Feb. 27, 2002 (JP) ..... 2002-050866

(51) Int. Cl.
*B41J 2/045* (2006.01)

(52) U.S. Cl. ..... 347/69; 347/68

(58) Field of Classification Search ..... 347/68, 347/69–72

See application file for complete search history.

(56) References Cited

U.S. PATENT DOCUMENTS 6,513,916 B1 2/2003 Isono et al.

6,547,375 B1 4/2003 Isono et al.

FOREIGN PATENT DOCUMENTS

| | | | |
|---|---|---|---|
| JP | 6-218918 | A | 8/1994 |
| JP | 7-186382 | A | 7/1995 |
| JP | 9-66602 | A | 3/1997 |
| JP | 9-94954 | A | 4/1997 |
| JP | 10-264382 | A | 10/1998 |
| JP | 11-10871 | A | 1/1999 |
| JP | 11-506402 | A | 6/1999 |
| JP | 2000-141640 | A | 5/2000 |
| JP | 2002-301823 | A | 10/2002 |
| JP | 2003-80697 | A | 3/2003 |
| WO | WO-97/39897 | A1 | 10/1997 |

*Primary Examiner*—Lamson Nguyen
*Assistant Examiner*—Lisa M. Solomon
(74) *Attorney, Agent, or Firm*—Birch, Stewart, Kolasch & Birch, LLP

(57) ABSTRACT

An ink-jet head includes a base member provided with a plurality of channel grooves separated from each other by channel walls and connecting front and rear ends together, a cover member arranged in contact with the base member and opposed to a surface provided with the plurality of channel grooves of the base member, an electrode arranged as a drive electrode on at least a part of inner surfaces of the channel grooves, and conductive resin arranged at the rear end to fill inner spaces of the channel grooves and electrically connected to the drive electrode. The rear end of the channel groove is shallower than the front end of the channel groove.

8 Claims, 12 Drawing Sheets

INK JET HEAD

BACKGROUND OF THE INVENTION

1. Field of the Invention

The present invention relates to an ink-jet head for use in a printer or the like, and particularly to an ink-jet head, in which an ink chamber is defined by walls containing a piezoelectric member, and a voltage is applied to the piezoelectric member to cause deformation and thereby to cause pressure vibrations in the ink chamber so that an ink accumulated in the ink chamber is ejected therefrom.

2. Description of the Related Art

In recent years, non-impact printing devices, e.g., of an ink-jet type, which can be easily configured to perform color printing and multilevel gradation, have been rapidly spreading instead of impact printing devices. As an ink-jet head used as an ink ejecting unit in the non-impact printing device, attention has been given particularly to a drop-on-demand type, which can eject only ink droplets required for the printing, in view of high ejection efficiency and easy reduction of cost. A Kyser type and a thermal jet type are mainstream of the drop-on-demand type.

However, the Kyser type does not allow easy reduction in size, and thus is not suitable for a high-density structure. The thermal jet type is suitable for a high-density structure, but requires ink having appropriate heat resistance because it uses a heater for heating the ink to generate bubbles, and ejects the ink by using energy of the bubbles. Also, it is difficult to provide a long-life heater. Further, an energy efficiency is low, and therefore power consumption is large.

An ink-jet type utilizing a shear mode of a piezoelectric material has been disclosed as a type overcoming problems of the foregoing types. In the ink-jet type, electrodes are formed on opposite side surfaces of a wall (which will be referred to as a "channel wall" hereinafter) of an ink channel made of a piezoelectric material, and an electric field perpendicular to a direction of polarization of the piezoelectric material is produced by using these electrodes so that the channel wall is deformed in a shear mode, and pressure wave variations caused thereby are utilized to eject ink droplets. This type is suitable to high-density arrangement of nozzles, low power consumption and high drive frequency.

Referring to FIG. 14, description will now be given on a structure of an ink-jet head utilizing the shear mode. This ink-jet head includes a base member 1, which is made of a piezoelectric material subjected to polarization processing in a vertical direction of FIG. 14, and is provided with a plurality of channel grooves 4, a cover member 2 provided with an ink supply port 21 and a manifold space 24, and a nozzle plate 9 having nozzle holes or orifices 10. Base member 1, cover member 2 and nozzle plate 9 are fixed together to form an ink channel. The "ink channel" is a portion of a pressure chamber formed by utilizing an inner space of channel grooves 4. On only an upper half of a channel wall 3, electrodes 5 are formed for applying an electric field. In the following description, the side, on which nozzle plate 9 is present, will be referred to as the front side, and the opposite side will be referred to as the rear side. In this ink channel, the rear end portion of each channel groove 4 is worked into a round or curved form corresponding to a diameter of a dicing blade used for forming the groove. Further, a shallow groove portion 6 is also formed by the dicing blade to provide an electrode leading portion for external electrical connection. The electrode formed in shallow groove portion 6 is connected at its rear end, e.g., to an external electrode 8 of a flexible printed board 11 by a bonding wire 7. In the ink-jet head of the above structure, the ink is supplied from manifold space 24 through the region of the round form. However, the pressure required for the ejection is to be generated in the region, where the upper portions of channel walls 3 of base member 1 are joined and fixed to cover member 2. Thus, the region of the round form is not required for such pressure generation, and becomes a cause of increase in electrostatic capacitance.

Japanese Patent Laying-Open No. 9-94954 has disclosed a structure of the ink-jet head, which is not provided with a round-shaped region and thereby can reduce the electrostatic capacitance. In the ink-jet head disclosed in this publication, however, connection is performed on a bottom surface of a base board for externally pulling out an electrode from a channel wall so that complicated steps are required for forming the electrode for connection.

As a structure, which can reduce an electrostatic capacitance of an ink-jet head and allows easy pull-out of an electrode from a channel wall, a structure shown in FIGS. 15 and 16 is already disclosed. FIG. 15 is a perspective exploded view of the ink-jet head with certain parts cut away. FIG. 16 is a cross section of an assembly of the ink-jet head. This ink-jet head has a feature that channel grooves 4 extend longitudinally throughout base member 1 with uniform depth. This structure can eliminate a round-shaped region, and can reduce an electrostatic capacitance. Also, it is possible to reduce a used amount of a piezoelectric material. Channel grooves 4 are sealed in the vicinity of their rear ends by electrically conductive resin 26 so that electrical connection is established to keep the same potential at electrodes 5 on the opposite sides of each channel groove 4. Conductive resin 26 reaches the rear ends of channel grooves 4, and the rear end of base member 1 is connected to flexible printed board 11 with anisotropic conductive film (which will be referred to as an "ACF" hereinafter) 12 therebetween. External electrode 8 on the surface of flexible printed board 11 and conductive resin 26 are pressed together in a direction of thickness of ACF 12 interposed therebetween, and thereby are electrically connected together. However, each ink channel is electrically independent of the others owing to characteristics of ACF 12.

In a conventional ink-jet head, conductive resin 26 in a liquid state is applied to the vicinity of the rear end of channel grooves 4, and then is cured. Therefore, a crack may occur between conductive resin 26 and channel wall 3 due to cure shrinkage of conductive resin 26. Conductive resin 26 is cured at a raised temperature, but conductive resin 26 has a larger coefficient of linear expansion than the piezoelectric material of base member 1. Therefore, thermal shrinkage, which occurs due to cooling after the curing, may cause a crack between conductive resin 26 and channel wall 3. FIG. 17 shows an example of a crack caused by the above reason. A crack 16 is present between conductive resin 26 and channel wall 3. This crack may cause a failure in electrical connection between electrode 5 and external electrode 8.

SUMMARY OF THE INVENTION

The invention provides an ink-jet head, which can prevent occurrence of a crack between conductive resin and a channel wall.

The ink-jet head according to the invention includes a base member having front and rear ends, and provided with a plurality of channel grooves separated from each other by a channel wall(s) including a piezoelectric material, and connecting the front and rear ends together; a cover member arranged in contact with the base member and opposed to a surface provided with the plurality of channel grooves of the base member; a drive electrode arranged on at least a part of inner surfaces of the channel grooves; and conductive resin arranged at the rear end to fill inner spaces of the channel grooves and electrically connected to the drive electrode. The rear end of the channel groove is shallower than the front end of the channel groove. According to the above structure, sufficient shear-mode deformation of the channel wall can be ensured in the vicinity of the front end, and further a required volume of the conductive resin can be reduced at the rear end. Accordingly, it is possible to reduce a stress, which occurs on an interface between the conductive resin and the channel wall due to cure shrinkage or thermal shrinkage of the conductive resin, and therefore occurrence of a crack can be prevented.

Preferably, the depth of the channel groove continuously decreases as the position moves from the front end toward the rear end. According to this structure, the ink can flow smoothly from a manifold space to an ink channel, and can be ejected stably.

Preferably, the channel groove includes a front region starting from the front end, and extending in a longitudinal direction of the channel groove, and has a uniform depth in the front region, and the depth of the channel groove at the rear end is smaller than the depth of the channel groove in the front region. According to this structure, the channel groove in the portion, which is particularly significantly related to ink ejection, has the uniform depth so that the efficiency of the shear-mode deformation of the channel wall can be increased, and the ink can be ejected efficiently.

Preferably, a region from the front end to a middle portion in the longitudinal direction of the channel groove includes a wall-fixed region having an upper end of the channel wall fixed to the cover member, and the wall-fixed region has a shorter length in the longitudinal direction of the channel groove than the front region. According to this structure, the channel groove has the uniform depth throughout the wall-fixed region so that the efficiency of the shear-mode deformation can be high throughout the wall-fixed region.

Preferably, the channel groove has a rear region starting from the rear end and extending in the longitudinal direction of the channel groove, and has a uniform depth in the rear region, and the depth of the channel groove in the rear region is smaller than the depth of the channel groove at the front end. This structure can prevent unintended forward flow of the conductive resin along the channel groove before curing. Therefore, an efficiency of application of the conductive resin can be improved, and a used amount of the conductive resin can be reduced.

Preferably, the ink-jet head includes an external electrode fixed to the rear end of the base member, the external electrode and the conductive resin are electrically connected together via an anisotropic conductive film interposed therebetween, and the channel groove has a sectional area of 2300 $\mu m^2$ or more at the rear end. According to this structure, the conductive resin can have at least a required minimum area for contact and connection to the external electrode via the anisotropic conductive film, and therefore the electrical connection can be ensured.

DETAILED DESCRIPTION OF THE INVENTION (First Embodiment)

Figure 1:
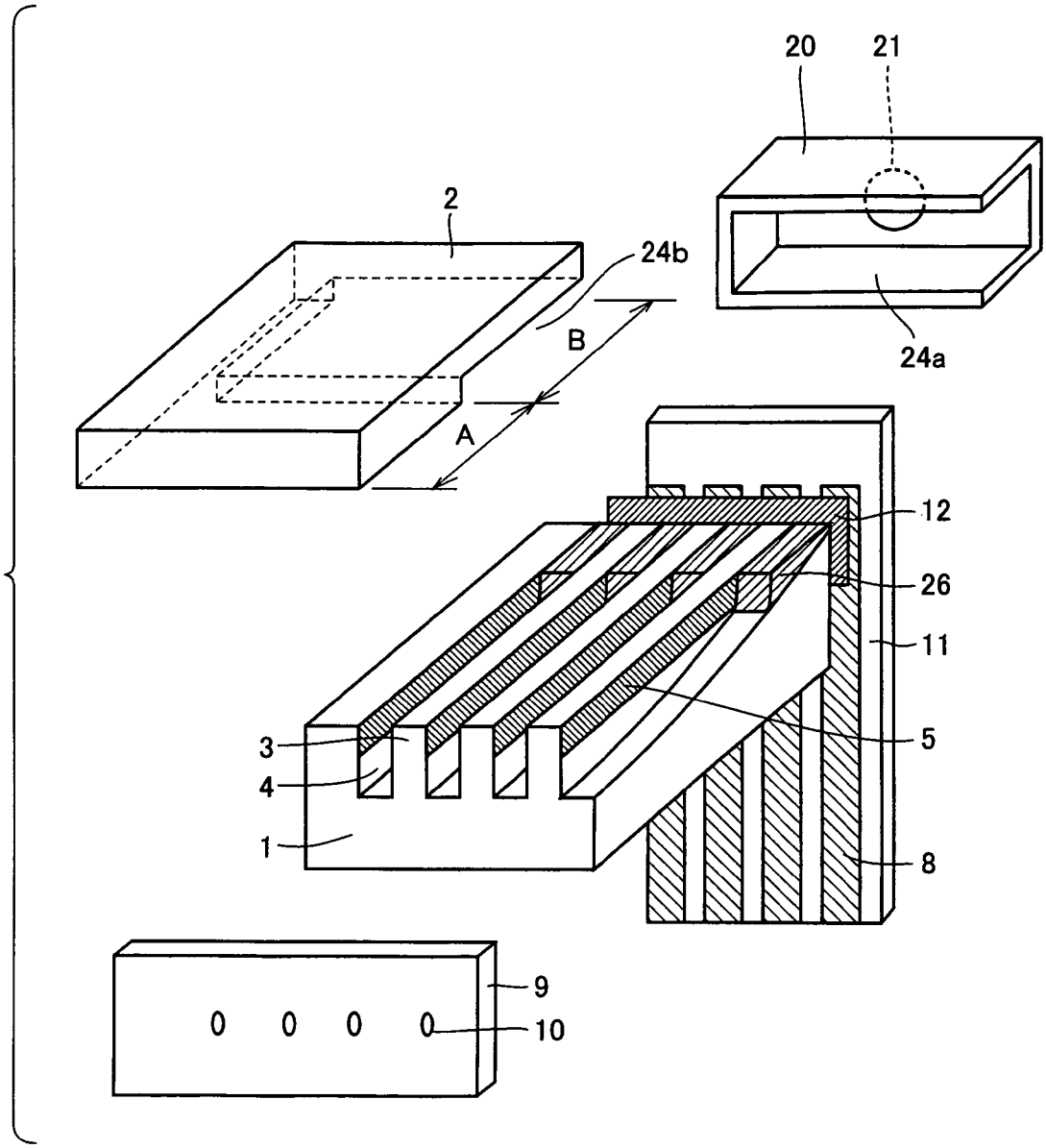
FIG. 1 is a perspective exploded view of an ink-jet head according to a first embodiment of the invention.
Figure 2:
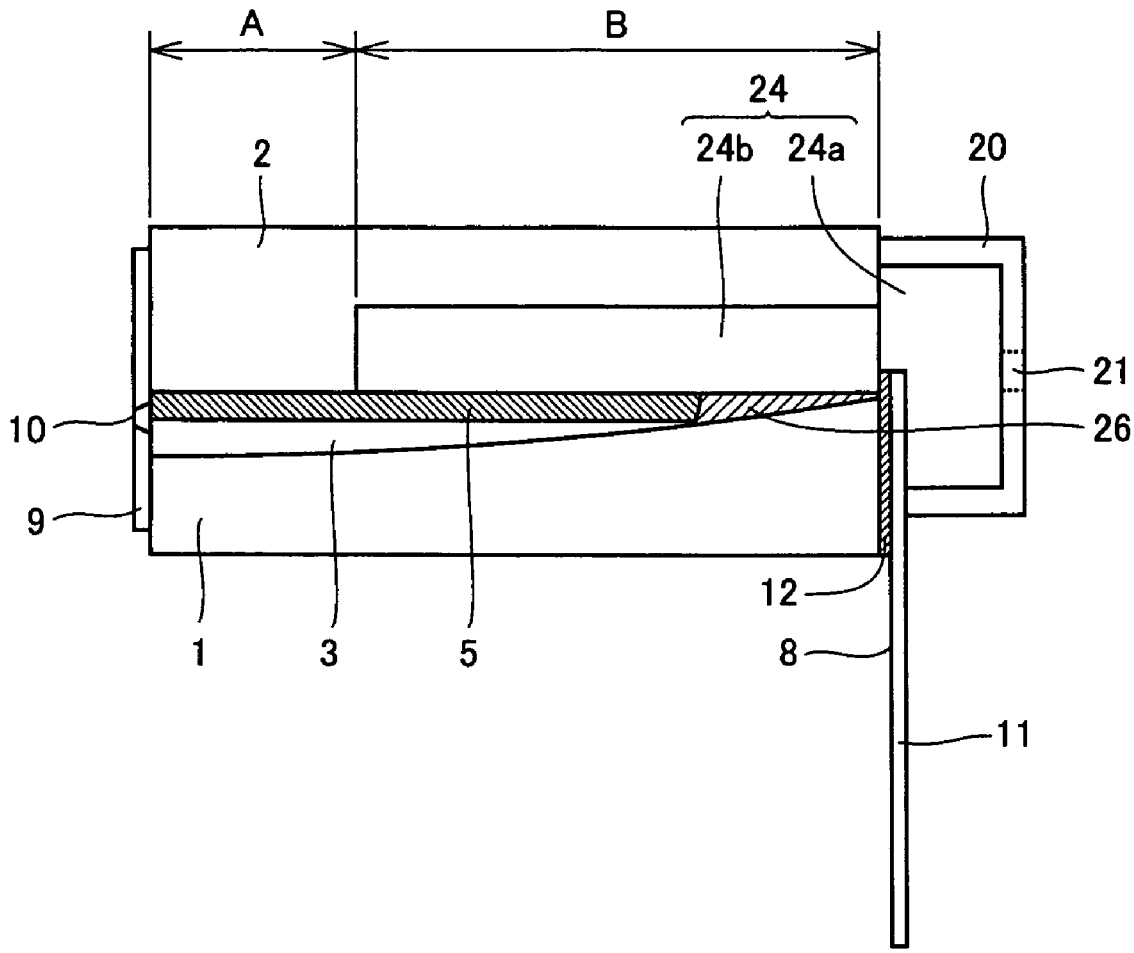
FIG. 2 is a cross section of the ink-jet head according to the first embodiment of the invention.
Figure 3:
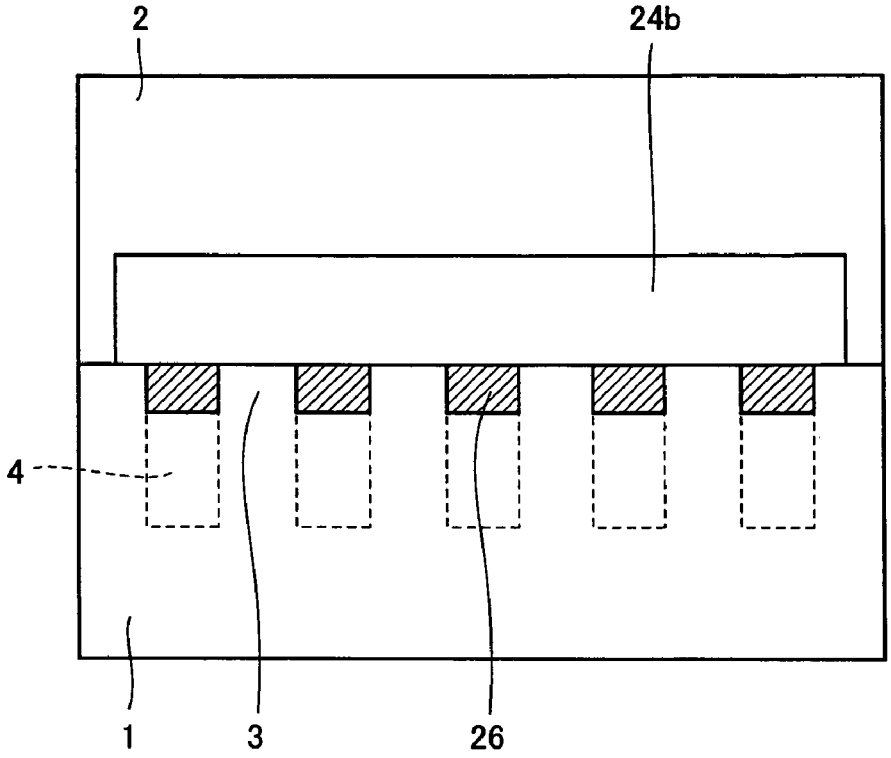
FIG. 3 is a rear view of the ink-jet head according to the first embodiment of the invention with a manifold member removed.

Referring to FIGS. 1 to 3, description will now be given on a structure of an ink-jet head according to a first embodiment of the invention. As shown in FIGS. 1 and 2, the ink-jet head has a front end, to which a nozzle plate 9 is attached, and a rear end opposite to the front end, and includes a base member 1 and a cover member 2 similarly to the structure shown in FIGS. 15 and 16. FIG. 1 is an exploded view showing structures with certain parts cut away for illustration. FIG. 2 is a cross section of the ink-jet head taken along line extending through a center of a channel groove 4 in a longitudinal direction of channel groove 4.

Base member 1 is made of a piezoelectric material, and is provided with the plurality of parallel channel grooves 4 extending between the front and rear ends. Channel grooves 4 are separated from each other by channel walls 3, which are a part of base member 1. On a substantially upper half of each side surface of channel wall 3, i.e., inner surface of channel groove 4, a thin electrode 5 is formed as a drive electrode for causing shear-mode deformation of channel wall 3. The rear end of channel groove 4 is filled with conductive resin 26 so that conductive resin 26 is electrically connected to electrode 5. Conductive resin 26 is electrically connected to an external electrode 8 on a surface of a flexible printed board 11 via an ACF 12.

Cover member 2 is provided with a concave portion forming a manifold space 24*b*. A manifold member 20 internally has a manifold space 24*a*. Manifold member 20 has an open front side, and is provided on its rear side with an ink supply port 21. Base member 1 and cover member 2 are joined together to form an assembly. Flexible printed board 11 is arranged on the rear end of the assembly thus formed, and manifold member 20 is attached thereto to close the rear end so that manifold spaces 24*a* and 24*b* are connected together to form a continuous manifold space 24.

Figure 15:
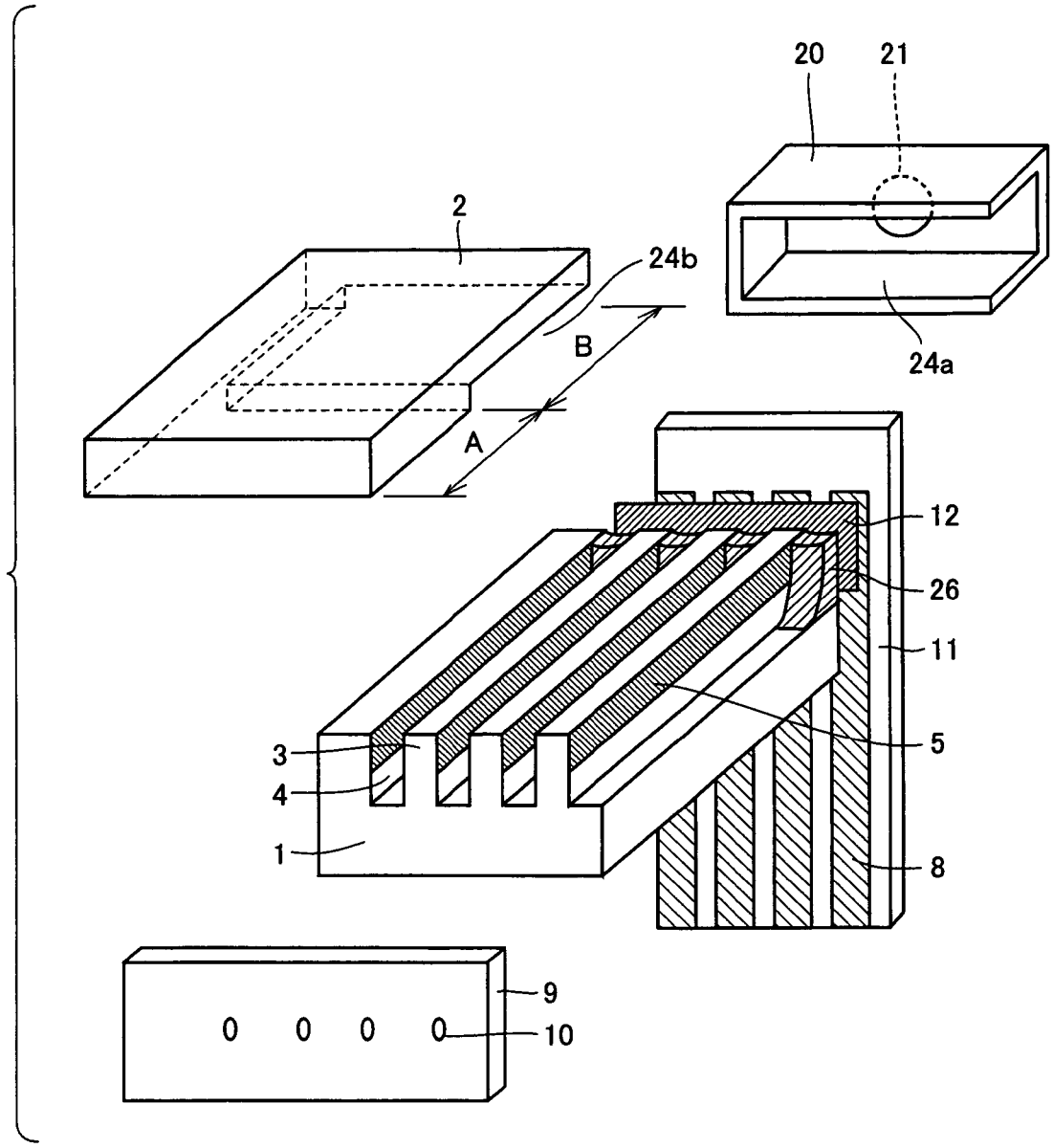
FIG.15 PRIOR ART
FIG. 15 is a perspective exploded view of a second ink-jet head according to the prior art.
Figure 16:
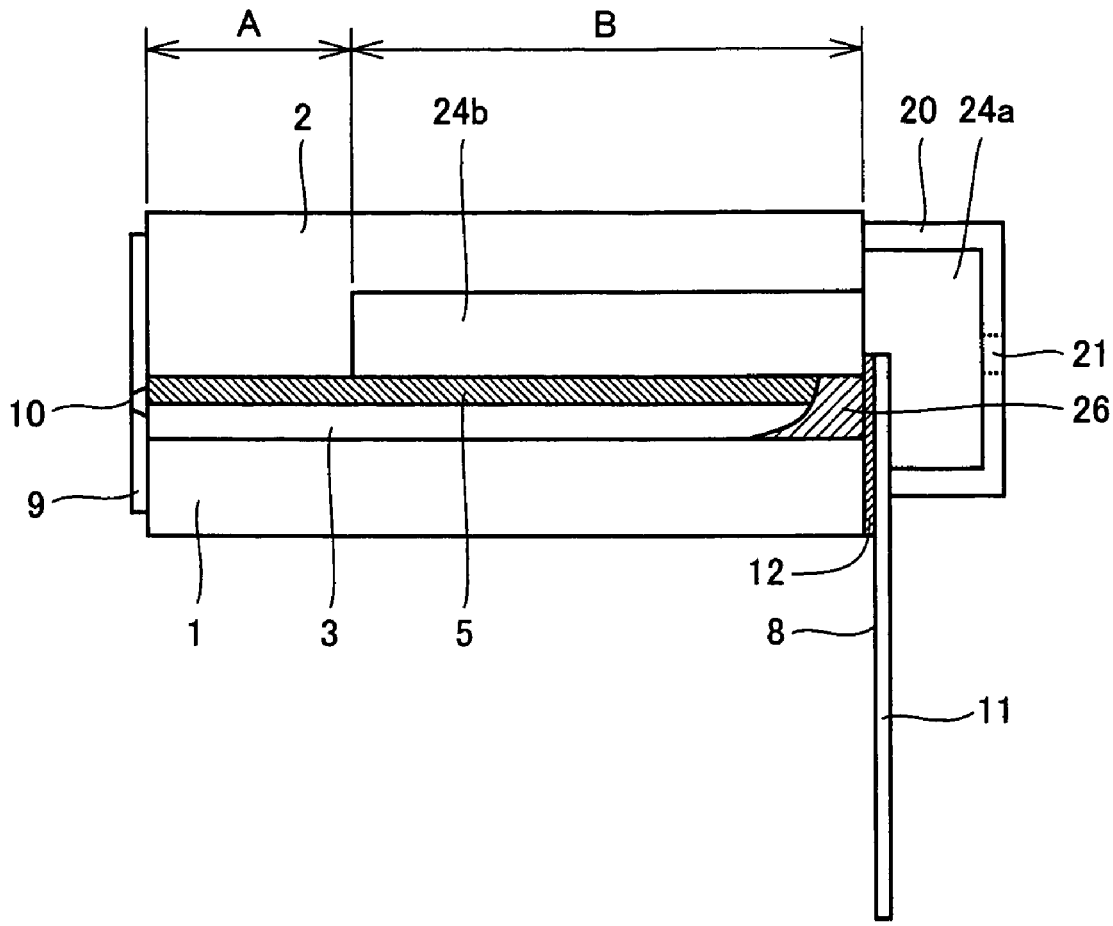
FIG.16 PRIOR ART
FIG. 16 is a cross section of the second ink-jet head according to the prior art.
Figure 17:
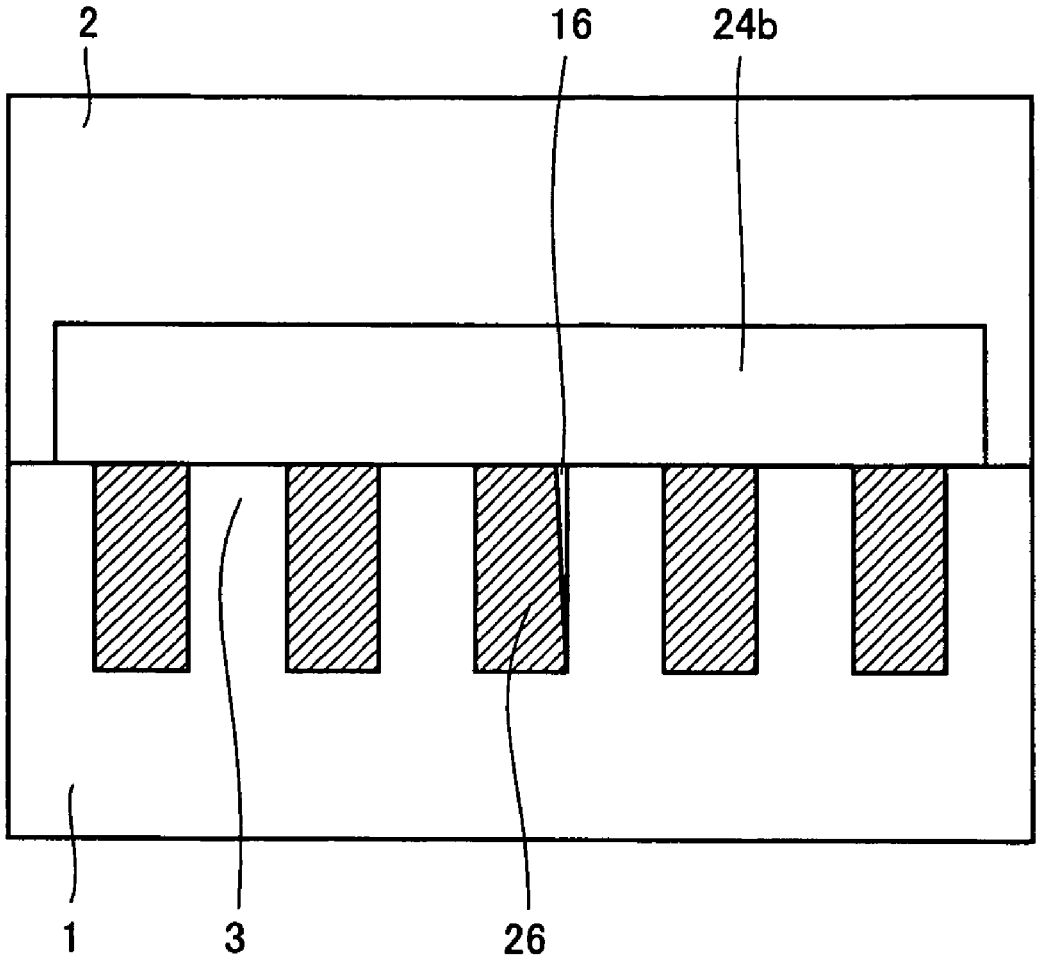
FIG.17 PRIOR ART
FIG. 17 shows an example of a crack in the second ink-jet head according to the prior art.

The foregoing structures are substantially the same as those of the conventional ink-jet head shown in FIGS. 15 and 16. However, the ink-jet head of the embodiment differs from the conventional ink-jet head in that the rear end of channel groove 4 is shallower than the front end of channel groove 4. The structure, in which the rear end of channel groove 4 is shallower than the front end thereof, is a basic feature of the invention, and the mere feature that the rear end is shallower than the front end can achieve an effect to a certain extent. However, it is preferable that the depth of channel groove 4 continuously decreases as the position moves from the front end toward the rear end, as shown in FIG. 2. This structure having the "continuously" decreasing depth does not eliminate a structure, which partially includes a flat portion having a uniform depth, but eliminates only a structure having a portion, in which the depth of channel groove 4 increases as the position moves toward the rear end.

FIG. 3 shows a rear view of the ink-jet head with manifold member 20 removed for illustration. Since channel grooves 4 are shallow at the rear end, exposed rear end portions of conductive resin 26 have a smaller total area than front end portions thereof represented by broken line.

Various portions of the ink-jet head have following specific sizes, and are manufactured as follows. Channel groove 4 has a depth of 300 μm, a width of 77 μm and a pitch of 169 μm. Referring to FIG. 2, a region A, in which base member 1 is in contact with cover member 2, has a length of 1.1 mm, and a region B, in which manifold space 24*b* is formed above channel grooves 4, has a length of 2.4 mm. The "lengths" related to the various regions are sizes in the longitudinal direction of channel grooves 4 unless otherwise specified.

Electrode 5 is made of aluminum, is formed by oblique vapor deposition and has a thickness of 1.0 μm. Instead of aluminum, electrode 5 may be made of an electrically conductive material such as copper, nickel or titanium.

Nozzle plate 9 is formed of a polyimide film of 50 μm in thickness, and nozzle holes 10 are formed by excimer laser processing. Nozzle plate 9 may be formed of a macromolecular resin film containing polyethylene instead of the polyimide film. Nozzle holes 10 may be formed in a metal plate such as a stainless steel plate by punching.

Cover member 2 is formed of an unpolarized piezoelectric substrate, and manifold space 24*b* is formed by sandblasting. Cover member 2 may be formed of a ceramic substrate. Manifold space 24*b* may be formed by milling or molding.

A rear end portion of each channel groove 4 is filled with electrically conductive resin 26, and ACF (Anisotropic Conductive Film) 12 is used for connection between external electrode 8 and conductive resin 26.

The following manner is employed for manufacturing the ink-jet head, in which channel groove 4 becomes shallower as the position moves from the front end toward the rear end.

Figure 4:
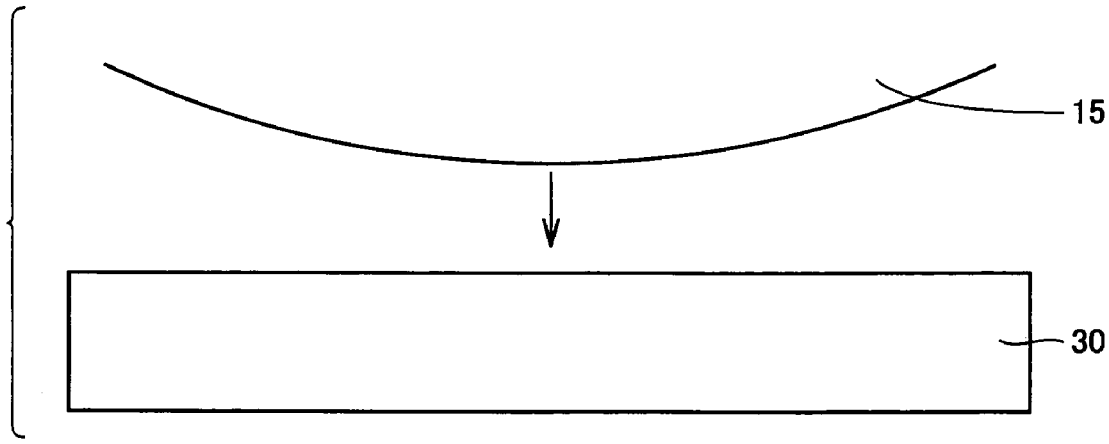
FIG. 4 is a first view illustrating a manufacturing step of the ink-jet head according to the first embodiment of the invention.
Figure 5:
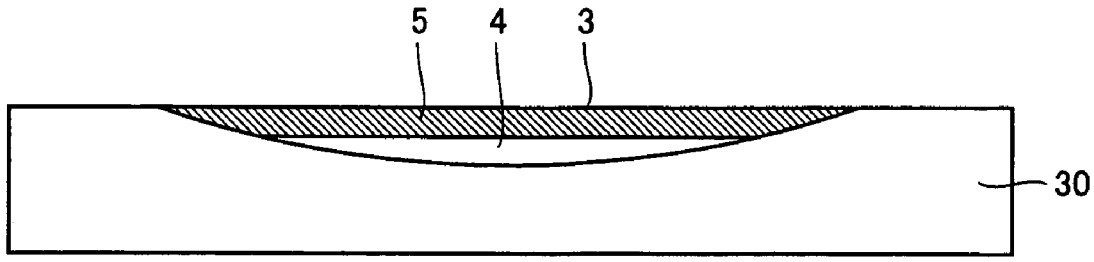
FIG. 5 is a second view illustrating the manufacturing step of the ink-jet head according to the first embodiment of the invention.

First, as shown in FIG. 4, a dicing blade 15 is lowered vertically toward a piezoelectric substrate 30, which is a material of base member 1, to form an arc-shaped portion or recess. Oblique vapor deposition with aluminum is effected to form electrode 5 on the upper half of each of side surfaces of channel walls 3, i.e., inner surfaces of channel grooves 4 thus formed, as shown in FIG. 5.

Figure 6:
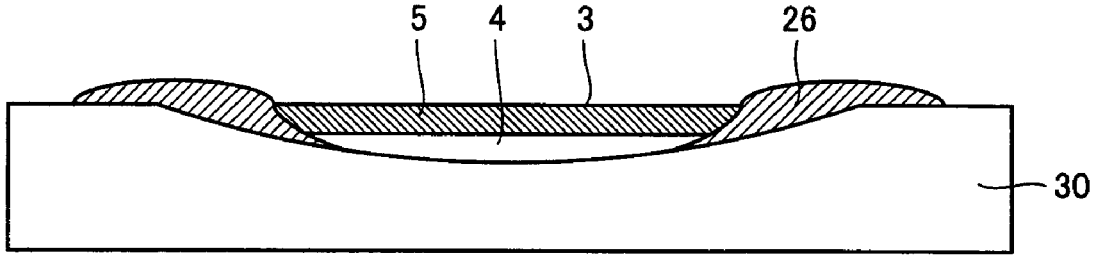
FIG. 6 is a third view illustrating the manufacturing step of the ink-jet head according to the first embodiment of the invention.
Figure 7:
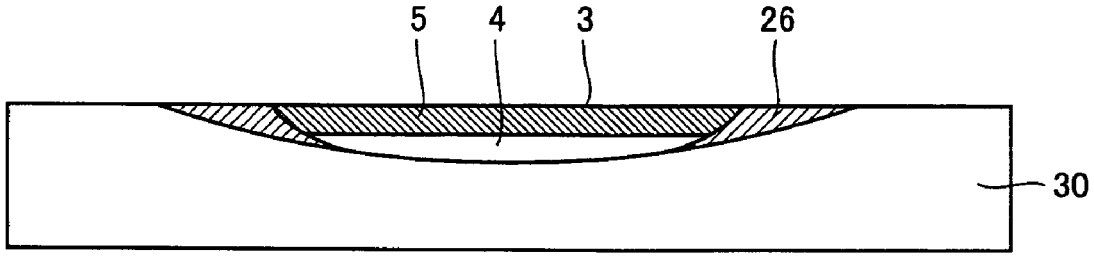
FIG. 7 is a fourth view illustrating the manufacturing step of the ink-jet head according to the first embodiment of the invention.
Figure 8:
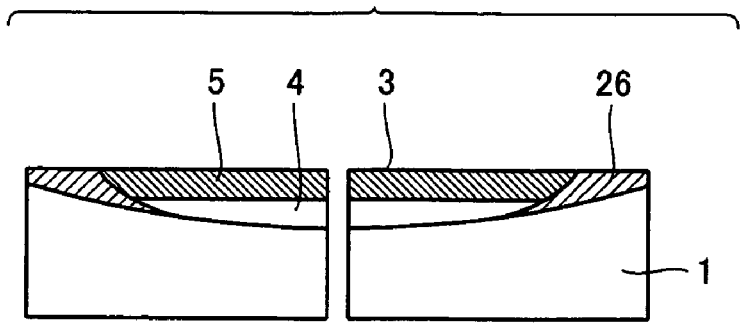
FIG. 8 is a fifth view illustrating the manufacturing step of the ink-jet head according to the first embodiment of the invention.

As shown in FIG. 6, conductive resin 26 is supplied from a dispenser (not shown) into opposite ends of channel groove 4, and is cured. As shown in FIG. 7, polishing is effected on the upper surface to remove a portion of conductive resin 26 overflowed from channel groove 4. Consequently, conductive resin 26 in each channel groove 4 is separated and electrically isolated from conductive resin 26 in neighboring groove(s) 4. As shown in FIG. 8, piezoelectric substrate 30 is cut off to provide pieces forming base members 1. In the above manner, working and processing can be performed symmetrically so that two base members 1 can be simultaneously produced.

It is assumed that dicing blade 15 has a radius of 25.4 mm, and provides a depth of 300 μm at a position forming the front end of the ink-jet head. In this case, the substrate can be cut at a position spaced by 3.5 mm from the front end so that channel groove 4 can have a depth of about 60 μm at the rear end.

According to the ink-jet head of the embodiment, the rear end of channel groove 4 has a smaller depth than the front end. Therefore, sufficient shear-mode deformation of channel walls 3 can be ensured in the vicinity of the front end owing to sufficiently deep channel grooves 4, and at the same time, it is possible to reduce a required volume of conductive resin 26 owing to the small depth of channel grooves 4 at the rear end. Therefore, it is possible to reduce a stress occurring on the interface between conductive resin 26 and channel wall 3 due to cure shrinkage or thermal shrinkage of conductive resin 26, and thus it is possible to prevent a crack between conductive resin 26 and channel wall 3. Owing to the prevention of the crack, reliable electrical connection can be ensured between electrode 5 and external electrode 8.

In the structure having the channel groove, of which depth continuously decreases as the position moves from the front end toward the rear end, the ink can smoothly flow from manifold space 24 into the ink channels so that the ink can be stably ejected.

In this embodiment, channel groove 4 has a depth of 60 μm at the rear end. It is preferable to reduce the depth at the rear end in view of reduction of the volume of conductive resin 26. However, excessively small depth causes such a situation that conductive resin 26 is connected to external electrode 8 via ACF 12 only through an excessively small contact area, and thus sufficient electrical connection is impossible. Thus, a certain area or more is required. For example, if channel groove 4 has a width of about 77 μm, the depth of 30 μm or more can ensure the sufficient electrical connection. This is owing to the fact that channel groove 4 has a sectional area of 2300 $\mu m^2$ or more at the rear end. Thus, an area of 2300 $\mu m^2$ or more is required for contact with conductive resin 26 for ensuring the sufficient electrical connection.

(Second Embodiment)

Figure 9:
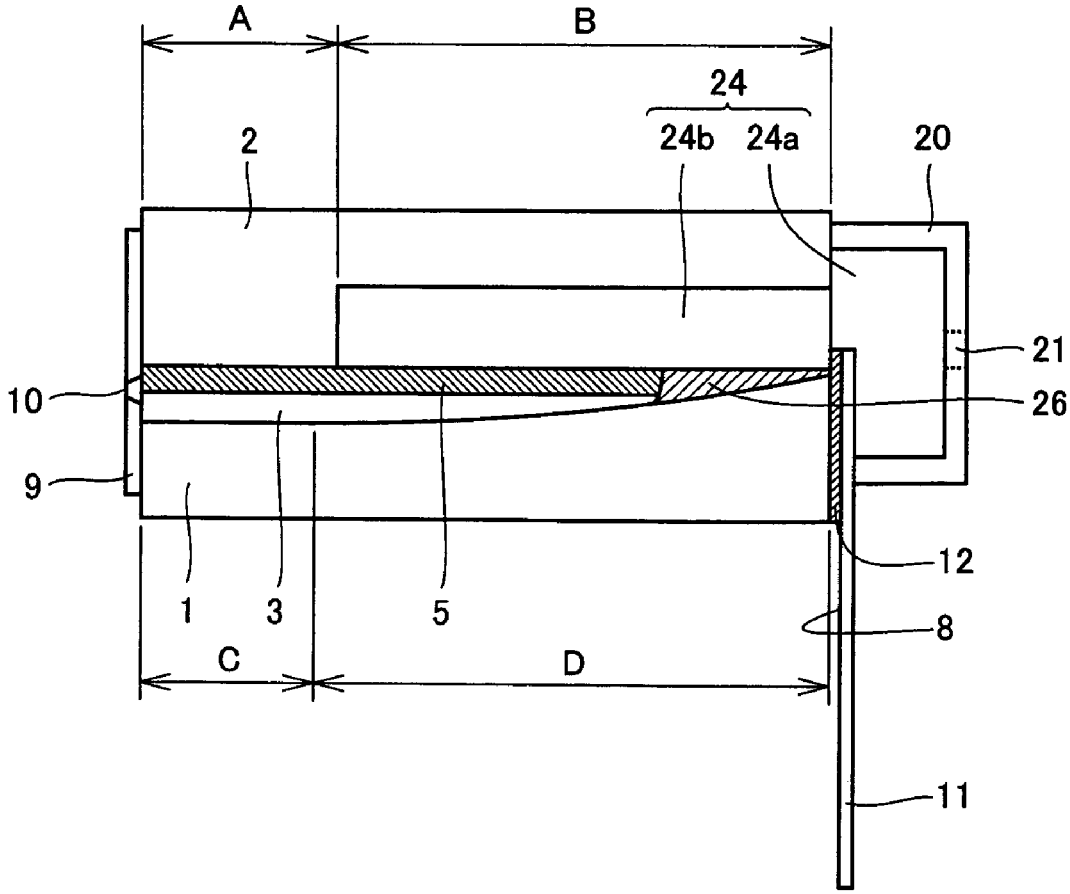
FIG. 9 is a cross section showing an ink-jet head according to a second embodiment of the invention.

Referring to FIG. 9, description will now be given on a structure of an ink-jet head according to a second embodiment of the invention. This ink-jet head is similar to that of the first embodiment of the invention except for that channel groove 4 has a portion of a uniform depth in a region C of a predetermined length starting from the front end. This region is referred to as a "front region". In a region D following region C, the depth of channel groove 4 continuously decreases as the position moves toward the rear end.

Figure 10:
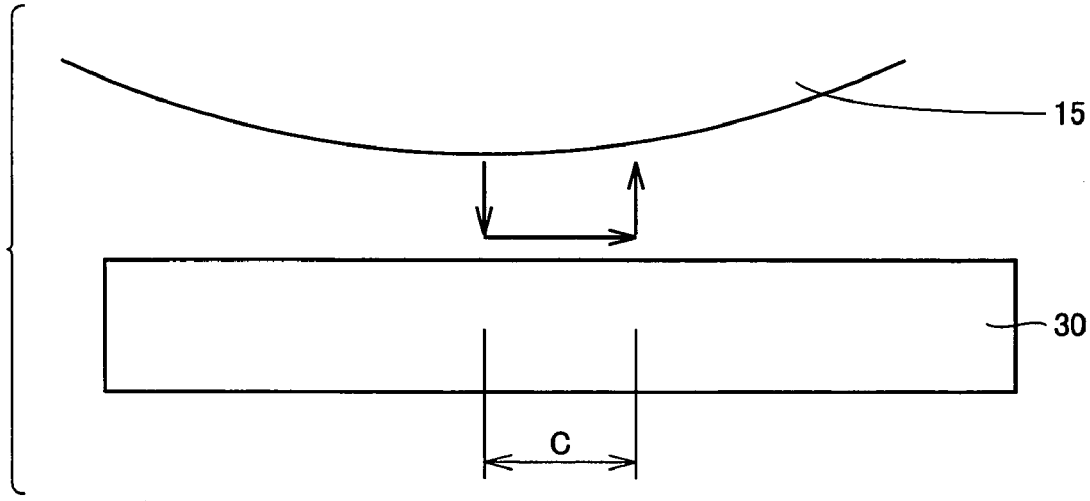
FIG. 10 is a first view illustrating a manufacturing step of the ink-jet head according to the second embodiment of the invention.
Figure 11:
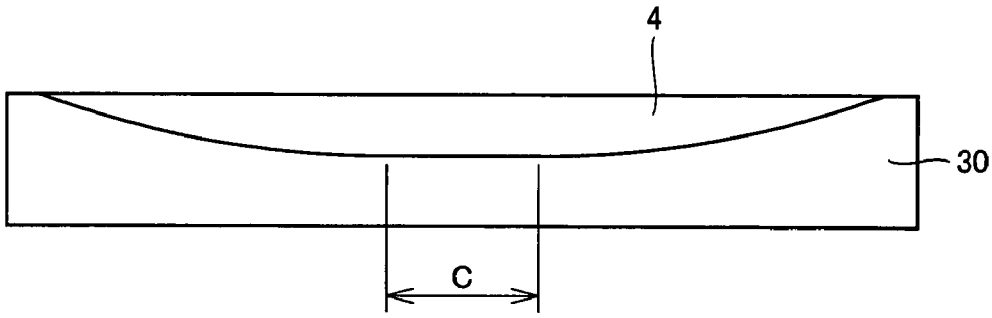
FIG. 11 is a second view illustrating the manufacturing step of the ink-jet head according to the second embodiment of the invention.

Various portions of the above ink-jet head have following specific sizes, and are manufactured as follows. Region A has a length of 1.1 mm, and region B has a length of 3.1 mm. Region C has a length of 1 mm. At the rear end, channel groove 4 has a depth of 100 μm. For forming region C, as shown in FIG. 10, dicing blade 15 is lowered vertically toward piezoelectric substrate 30, which is a material of base member 1, and then is horizontally moved in the longitudinal direction of channel groove 4 so that a structure shown in FIG. 11 can be easily formed. In this embodiment, channel groove 4 has a depth of 300 μm at the front end, and region C has a length of 1 mm so that the structure can be formed by horizontally moving dicing blade 15 kept at a cutting depth of 300 μm for a distance of 1 mm. In the example of FIGS. 10 and 11, only one region C is formed. However, symmetrical two base members 1 can be produced at the same time as shown in FIGS. 7 and 8 by horizontally moving dicing blade 15 for a distance equal to a sum of double the length of region C and a cut thickness.

Region A is a wall-fixed region, in which an upper end of channel wall 3 is fixed to cover member 2. In region A, shear-mode deformation of channel wall 3 occurs to generate a pressure required for ink ejection. Region C having channel groove 4 of the uniform depth substantially overlaps with region A, and therefore the efficiency of shear-mode deformation of channel wall 3 can be increased, in addition to the effect similar to that of the first embodiment already described. Therefore, the ink can be ejected efficiently.

Figure 12:
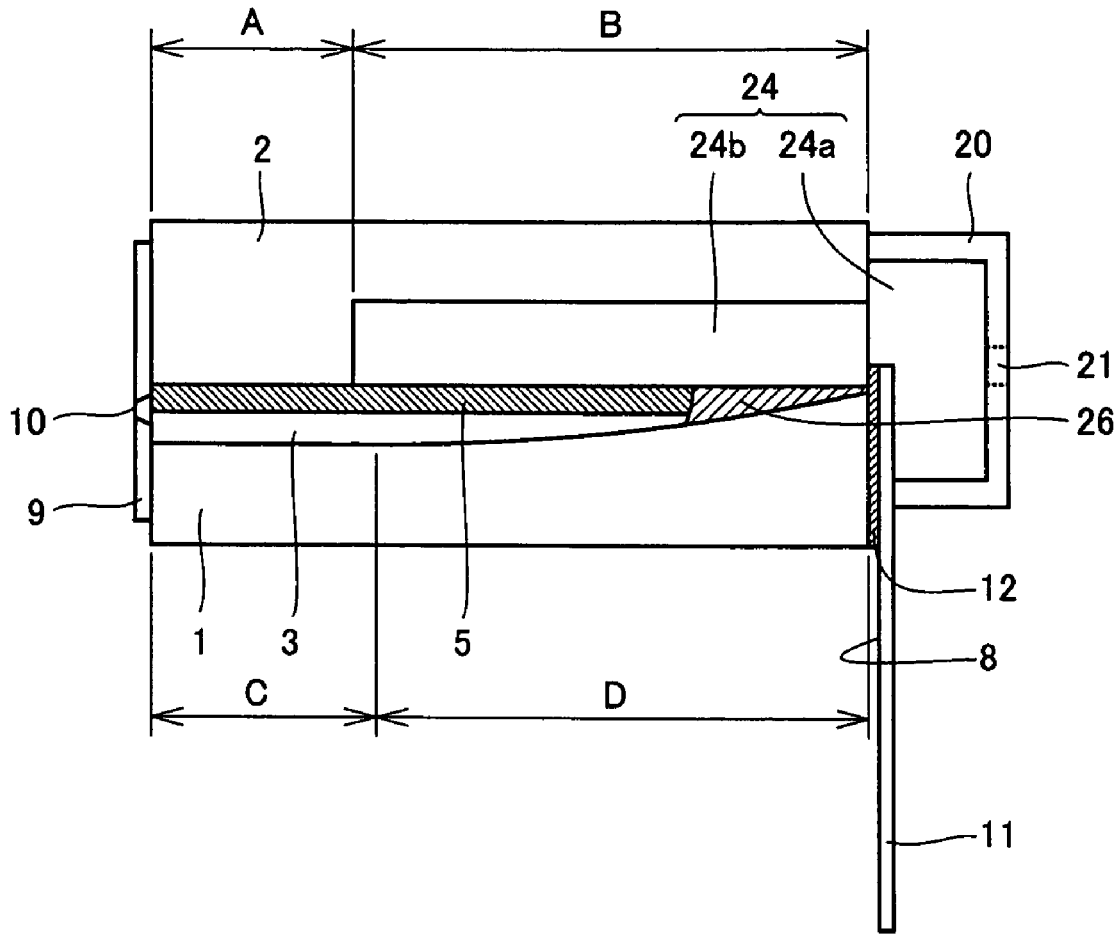
FIG. 12 is a cross section of a further preferable example of the ink-jet head according to the second embodiment of the invention.

In the example already described with reference to FIG. 9, region C (front region) has a smaller length than the wall-fixed region (region A). However, it is preferable that the length of region C is equal to or larger than that of region A as shown in FIG. 12. In this structure, channel groove 4 has a uniform depth throughout region A so that the efficiency of shear-mode deformation can be high throughout region A. Therefore, the above structure is preferable.

(Third Embodiment)

Figure 13:
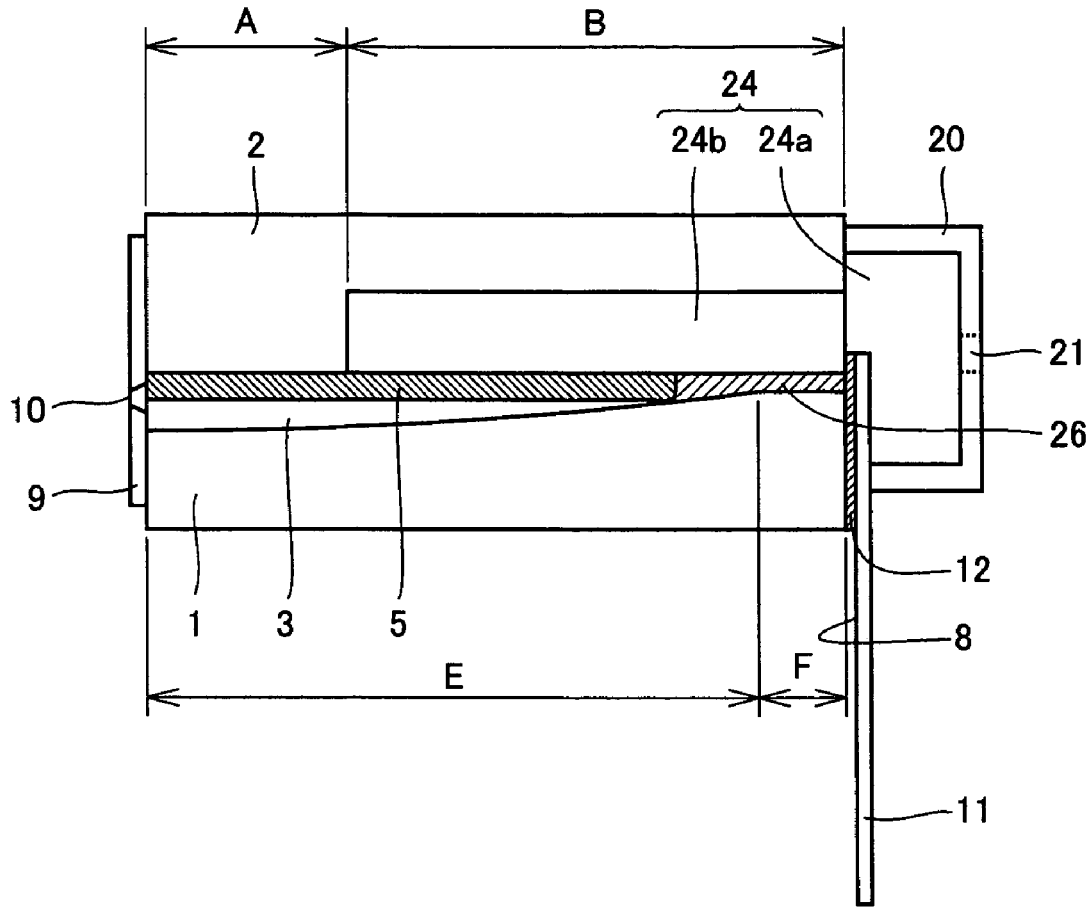
FIG. 13 is a second view illustrating a manufacturing step of an ink-jet head according to a third embodiment of the invention.
Figure 14:
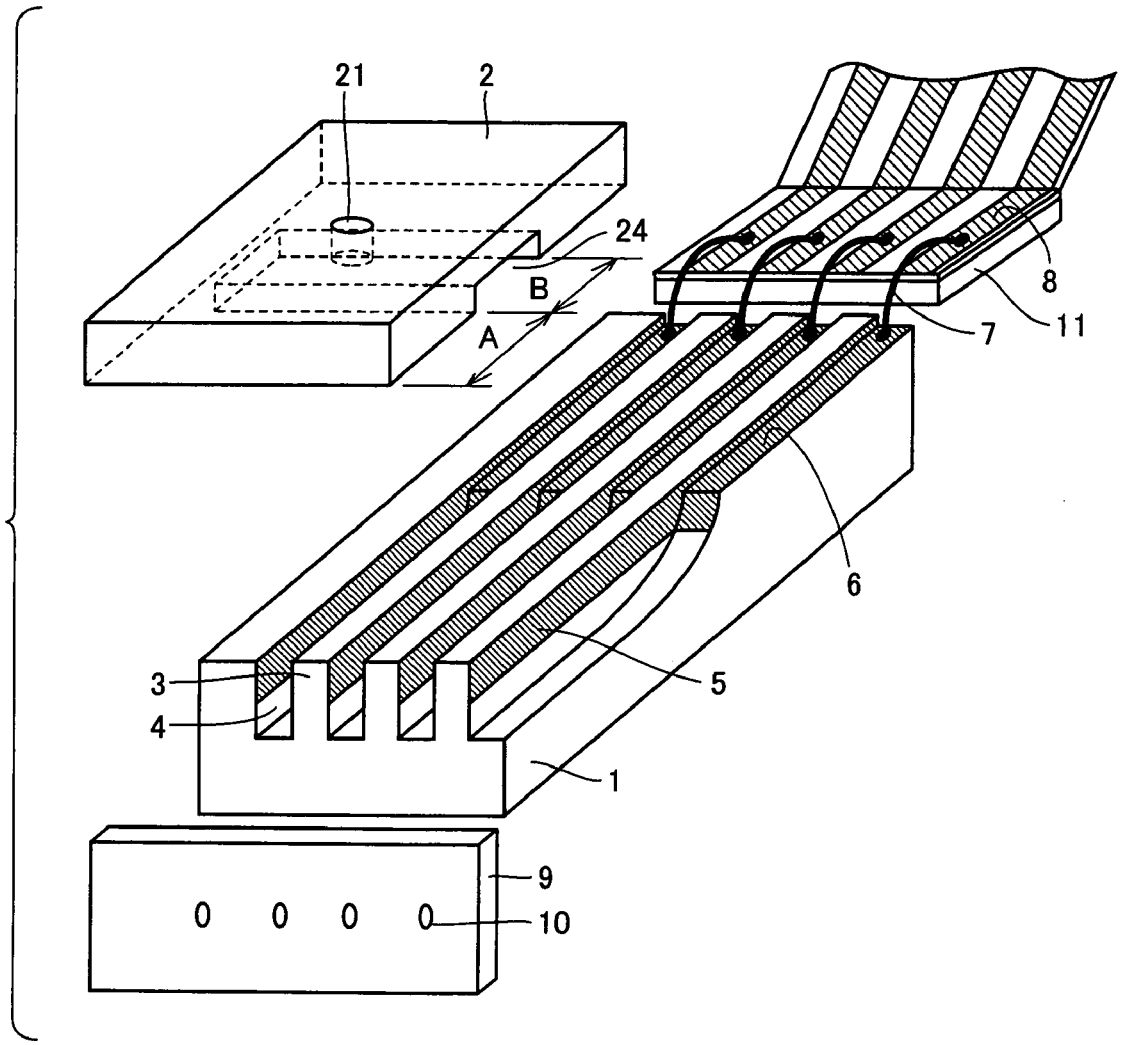
FIG.14 PRIOR ART
FIG. 14 is a perspective exploded view of a first ink-jet head according to a prior art.

Referring to FIG. 13, a structure of an ink-jet head according to a third embodiment of the invention will now be described. This ink-jet head is basically similar to that of the first embodiment except for that channel groove 4 has a portion of a uniform depth in a region F of a predetermined length starting from the rear end. This region is referred to as a "rear region". In a region E preceding region F, the depth of channel groove 4 continuously decreases as the position moves toward the rear end.

Various portions of the above ink-jet head have following specific sizes, and are manufactured as follows. Region A has a length of 1.1 mm, and region B has a length of 2.4 mm. Region F has a length of 0.5 mm. In region F, channel groove 4 has a depth of 60 μm. Region F can be easily formed by horizontally moving dicing blade 15 when processing the piezoelectric substrate.

According to the ink-jet head of the third embodiment, region F including channel groove 4 of the uniform depth is present in the region near the rear end, where conductive resin 26 is arranged. Therefore, such an undesired situation can be prevented that uncured conductive resin 26 flows forward along channel groove 4 when conductive resin 26 is supplied from a dispenser. Consequently, an efficiency of application of conductive resin 26 can be increased, in addition to the effect similar to that of the first embodiment already described. Increase in application efficiency results in decrease in used amount of conductive resin 26.

According to the invention, the shear-mode deformation of the channel wall can be sufficiently ensured in the vicinity of the front end, and further the volume of the conductive resin can be reduced at the rear end. Therefore, it is possible to reduce the stress occurring on the interface between the conductive resin and the channel wall due to cure shrinkage or thermal shrinkage of the conductive resin, and occurrence of a crack between the conductive resin and the channel wall can be prevented.

Although the present invention has been described and illustrated in detail, it is clearly understood that the same is by way of illustration and example only and is not to be taken by way of limitation, the spirit and scope of the present invention being limited only by the terms of the appended claims.

INDUSTRIAL APPLICABILITY

The invention can be applied to the ink-jet heads arranged in printers or the like of the ink-jet type.

The invention claimed is:

1. An ink-jet head, comprising:

a base member having front and rear ends, and provided with a plurality of proximate ink receiving channel grooves each defined and separated from another by a respective one of a plurality of channel walls each including a piezoelectric material, and said walls extending between and connecting said front and rear ends together;

a cover member arranged in contact with said base member and opposed to a surface of said base member provided with said plurality of channel grooves;

said channel grooves having inner spaces defined by inner surfaces;

a drive electrode formed on at least a portion of inner surfaces of each of said channel grooves; and conductive resin arranged at said rear end of said base member to fill each of said inner spaces of each of said channel grooves adjacent said rear end and being electrically connected to each said drive electrode; wherein said rear end of each of said the channel grooves is shallower than said front end of each said channel groove.

2. The ink-jet head according to claim 1, wherein the depth of said each of said channel grooves continuously decreases as the position moves from said front end toward said rear end.

3. The ink-jet head according to claim 1, wherein said each of said channel grooves includes a rear region starting from said rear end and extending in a longitudinal direction of said each of said channel grooves, and has a uniform depth in said rear region, and the depth of said each of said channel grooves in said rear region is smaller than the depth of said each of said channel grooves at said front end.

4. The ink-jet head according to claim 1, further comprising:

an external electrode fixed to said rear end of said base member, wherein said external electrode and said conductive resin are electrically connected together via an anisotropic conductive film interposed therebetween, and said each of said channel grooves has a sectional area of 2300 $\mu m^2$ or more at said rear end.

5. The ink-jet head according to claim 1, wherein said each of said channel grooves includes a front region starting from said front end, and extending in a longitudinal direction of said each of said channel grooves, and has a uniform depth in said front region, and the depth of said each of said channel grooves at said rear end is smaller than the depth of said each of said channel grooves in said front region.

6. The ink-jet head according to claim 5, wherein said each of said channel grooves includes a rear region starting from said rear end and extending in a longitudinal direction of said each of said channel grooves, and has a uniform depth in said rear region, and the depth of said each of said channel grooves in said rear region is smaller than the depth of said each of said channel grooves at said front end.

7. The ink-jet head according to claim 5, wherein a region from said front end to a middle portion in the longitudinal direction of said each of said channel grooves includes a wall-fixed region having an upper end of said channel wall fixed to said cover member, and said wall-fixed region has a shorter length in the longitudinal direction of said each of said channel grooves than said front region.

8. The ink-jet head according to claim 7, wherein said each of said channel grooves includes a rear region starting from said rear end and extending in a longitudinal direction of said each of said channel grooves, and has a uniform depth in said rear region, and the depth of said each of said channel grooves in said rear region is smaller than the depth of said each of said channel grooves at said front end.

* * * * *